United States Patent [19]

Ward et al.

[11] 4,157,945

[45] Jun. 12, 1979

[54] TRIVALENT CHROMIUM PLATING BATHS

[75] Inventors: John J. B. Ward, Wantage; Clive Barnes, West Hanney, both of England

[73] Assignee: International Lead Zinc Research Organization, Inc., New York, N.Y.

[21] Appl. No.: 864,515

[22] Filed: Dec. 27, 1977

[30] Foreign Application Priority Data

Mar. 4, 1977 [GB] United Kingdom ..... 9288/77

[51] Int. Cl.[2] ..... C25D 3/06

[52] U.S. Cl. ..... 204/51

[58] Field of Search ..... 204/51, 105 R, 43 R

[56] References Cited

U.S. PATENT DOCUMENTS

| | | | |
|---|---|---|---|
| 2,088,615 | 8/1937 | Schlötter | 204/51 |
| 3,954,573 | 5/1976 | Dahlgren et al. | 204/43 S |
| 4,053,374 | 10/1977 | Crowther | 204/51 |
| 4,062,737 | 12/1977 | Barclay et al. | 204/43 R |

FOREIGN PATENT DOCUMENTS

| | | | |
|---|---|---|---|
| 36-40761 | 2/1971 | Japan | 204/51 |
| 1482747 | 8/1977 | United Kingdom | 204/51 |
| 1488381 | 10/1977 | United Kingdom | 204/51 |
| 1498533 | 1/1978 | United Kingdom | 204/51 |

*Primary Examiner*—G. L. Kaplan

*Attorney, Agent, or Firm*—Brumbaugh, Graves, Donohue & Raymond

[57] ABSTRACT

An electrolyte bath and a method for using such a bath comprising trivalent chromium ions dissolved in an aqueous solution containing sulphide. The bath may also contain a weak complexing agent such as hypophosphite or glycine. The electrolyte according to the invention permits the electrodeposition of chormium from electrolytes having low solids content without adversely affecting plating rates.

6 Claims, No Drawings

TRIVALENT CHROMIUM PLATING BATHS

The present invention relates to trivalent chromium plating baths. It is known to electroplate chromium from aqueous baths containing trivalent chromium ions and an organic buffer, preferably an aprotic buffer such as dimethylformamide (DMF). Such techniques are described in British patent specification No. 1,144,913. In electroplating from electrolytes buffered with e.g. DMF it is advantageous to ensure, so far as possible, that the electrolyte has a single anion, usually sulphate or chloride.

More recently a variety of trivalent chromium electrolytes have been developed which use weak complexing agents instead of or, optionally but not usually preferably, with an organic buffer. Typical weak complexing agents are hypophosphite, usually as the sodium salt, glycine and mixtures of these. Such systems are described in U.S. Pat. No. 3,917,517, pending U.S. patent application Ser. No. 668,443, now abandoned, and abandoned U.S. patent application Ser. Nos. 630,801 and 668,442, which are incorporated herein by reference. The term "weak complexing agent for trivalent chromium ions" is used and defined herein as meaning a complexing agent for trivalent chromium ions which does not bind trivalent chromium so strongly as to prevent electrodeposition of chromium from aqueous trivalent chromium solutions containing it.

For commercial purposes, it is desirable to use such plating baths at a solids content of around 550 grams per liter and a chromium metal content of around 40 grams per liter. If the known solutions are diluted to concentrations significantly below these figures, the plating rate very rapidly decreases with the result that little or no plating is achieved. On the other hand, when the plated article is removed from the bath, it drags out with it an amount of aqueous solution which may contain up to five times the amount of chromium that has actually been electrodeposited. This drag-out phenomenon is a major source of expense. Accordingly, the use of a more dilute plating solution would reduce the drag-out problem. It is an object of the present invention to provide an additive for aqueous trivalent chromium plating electrolytes which enables the solids content to be reduced without a concomitant reduction in the plating rate. Put another way, it is an object of the invention to provide an additive which increases the plating rate of aqueous trivalent chromium plating electrolytes at any given solids content.

The present invention provides an aqueous trivalent chromium plating electrolyte comprising dissolved trivalent chromium preferably in a concentration of at least 0.1 molar, and from 1 to 300 parts per million by weight of dissolved sulphide.

It has been found according to the invention that dissolved sulphide substantially increases the plating rate of these solutions at any given solids content, and hence enables the solids content of the plating solution to be reduced without loss of performance. For example, 50 parts per million by weight of dissolved sulphide roughly doubles the plating rate at 550 grams per liter solids content of the electrolyte; and thus enables the solids content of the electrolyte to be reduced to around 300 grams per liter without impairing plating performance. It is contemplated that electrolytes according to the present invention have a solids content of from 250 to 700 grams per liter and preferably from 300 to 550 grams per liter.

The concentration of trivalent chromium ions is generally in the range of 0.2 molar to 2.0 molar with an optimum concentration of about 0.8 molar for decorative plating.

The particular concentration and precise nature of the weak complexing agent are not critical to the invention. Hypophosphite and/or glycine are the preferred weak complexing agents and will typically be used at a concentration of from 0.1 to 6 molar preferably 0.25 to 3 molar, the upper limit being largely a function of solubility. Glycine is additionally advantageous because the chromium deposit usually has a lighter color.

The dissolved sulphide is used at a concentration of from 1 to 300 and preferably 10 to 50 parts per million by weight. The effect described above is observable at concentrations as low as 1 part per million, but such concentrations are difficult to control and 10 parts per million is regarded as a practical minimum. The effect increases with increasing sulphide concentration, but above 50 parts per million other undesirable effects also make themselves felt. Above 300 parts per million these side effects become paramount. One such effect is that the appearance of the chromium deposits may be dulled while another is that hydrogen sulphide is both foul smelling and toxic. In the acid conditions typical of trivalent chromium plating baths the sulphide is converted to a large extent to hydrogen sulphide, and this tends to be given off as a gas, particularly when, as is usual, air agitation of the electrolyte is used.

The nature of the sulphide is not critical. The sulphide may be added to the electrolyte in any convenient form, for example as solid sodium sulphide or as an aqueous solution of ammonium sulphide. It may even be formed in situ in the plating bath for example by adding a thiocyanate or cystine, which decompose in the acid conditions of the bath to yield dissolved sulphide. However, such in situ formation is generally not preferred since by-products are also formed which may be harmful to the chromium plate. The sulphide could be added as a zinc or iron or some other metal salt, but this should be done with caution as it involves the addition of extraneous metal ions to the electrolyte. In general, it is preferred to use a cation which is inert in the electrolyte.

Additions of sulphide may need to be made to the electrolyte every few hours during plating. If it is desired to make additions at less frequent intervals, for example, once a shift, it is possible to use a tablet from which the sulphide dissolves only slowly. For example, sodium chloride/sodium sulphide tablets are commercially available for effluent disposal and could readily be utilized in the electrolyte of this invention. While it is possible to monitor the sulphide concentration of the electrolyte, and to add more sulphide as and when required, it may be simpler to periodically remove all sulphide from the electrolyte and then to add the required sulphide in a fresh batch. Removal of sulphide can readily be effected by adding a few cc.'s of hypochlorite or hydrogen peroxide to the electrolyte, both these compounds reacting rapidly and completely with sulphide. Following such additions it is, however, necessary to delay plating until the hypochlorite or hydrogen peroxide has itself decomposed. Hypochlorite decomposes rapidly, but hydrogen peroxide may take up to half an hour to disappear from the electrolyte.

The chemical mechanism by which the sulphide exerts its effects is not presently understood. Experiments using cells with a diaphragm demonstrate that the effect is not an anode reaction, i.e. the sulphide does not act by preventing the formation of chlorine or hexavalent chromium to the anode. It seems likely that the effect is a cathode reaction.

In order to ensure a relatively high electrolyte conductivity it is usual to include ammonium ion in the electrolyte. When used, the concentration of ammonium ion will typically be from 1 to 7 molar. In this regard, it is not preferable in the electrolytes of this invention, as it was preferable in previous trivalent chromium plating electrolytes, that the ammonium concentration should be greater than 5 molar for optimum effect. As is conventional in the art, part of the ammonium ion can be replaced by alkali metal ion; and this will normally be desirable since the presence of high concentrations of ammonium ion makes effluent disposal more difficult. Alkali metal ion concentration is typically 0.5 molar or higher.

Boric acid or a borate or fluoroborate is conventionally used in trivalent chromium plating electrolytes at a concentration of from 0.03 molar up to 1 molar, particularly about 0.75 molar, both for its buffering action and because it improves deposition efficiency at high current densities. The electrolytes of the present invention preferably contain boric acid, a borate or a fluoroborate for its buffering properties. But the dissolved sulphide itself provides the desired improvement in electrodeposition efficiency at high current densities.

The nature of the anions present in the electrolyte is not critical. Among the preferred anions are halide (e.g. fluoride, chloride, bromide and iodide), sulphate and phosphorus oxyanions. Unless the electrolyte contains DMF or some other dipolar organic material, no advantage is gained by using a single anion, and in fact it is preferred to use a mixture of chloride and sulphate. Chromic sulphate is used in the tanning industry, and is accordingly available commercially at reasonable cost, but has rather poor electrical conductivity. Chromic chloride is some five times as expensive as chromic sulphate, but has superior conductivity. It will often be convenient to make the bath up using chromic sulphate plus ammonium or an alkali metal chloride.

As described in U.S. patent application Ser. No. 668,443, fluoride ions may be included in the electrolyte at a concentration of at least 0.025 molar to improve the low temperature stability of the electrolyte, particularly when a substantial proportion of the anions are sulphate. Preferably, the concentration of fluoride is up to 1.25 molar, optimally from 0.1 to 0.7 molar. Conveniently the fluoride may be added as sodium fluoride, though other fluorides containing salts and materials may be used, suitably at a concentration of 5 to 25 grams per liter.

Other additives may be present in the electrolyte in accordance with what is known in the art. Surfactants may be used to improve wetting and decrease spray. Where it is desired to electrodeposit alloys of chromium with some other metal, for example iron, such other metal needs to be present in the electrolyte at an appropriate concentration. Inert particulate material may be included in the electrolyte for incorporation in the chromium electroplate.

In making up the electrolytes of the present invention, the pH changing technique described in U.S. Patent Application No. 630,801 may be of value.

Electrolytes of the present invention typically have a pH in the range of 1.5 to 4. They are used to a temperature of 10° C. to 50° C., typically ambient or a little above, e.g. 35° C. However, the operating temperature is not critical.

The plating range is typically from 80 to 10,000 amps per square meter. Because of the increased efficiency given to the electrolytes, the average plating rate, at a typical current density of 1000 A/m$^2$, may be as high as 0.2 μm per minute. Higher rates of deposition can be achieved by raising the temperature or reducing the pH.

The following Examples are illustrative of the invention. In the Examples, chrometan is a commercially available product obtained by reducing sodium dichromate, and contains substantially 3 molar parts of sodium sulphate, 2 molar parts of chromic sulphate and 1 molar part of chromic oxide. In the Examples also, the quoted concentrations of sulphide-containing compounds are expressed in terms of the sulphide itself, and not of the sulphide-containing compound.

EXAMPLE 1

A chromium plating solution was prepared according to the formulation:

240 g/l 33% basic $SO_2$ reduced chrometan
40 g/l boric acid
150 g/l ammonium chloride
100 g/l sodium hypophosphite
20 g/l sodium fluoride
pH=2.9
temp. =30° C.

The solution was electrolyzed in a Hull Cell at a current of 10 amps for 1 minute. The thickness of chromium at various current densities was measured. The test was repeated with various concentrations of ammonium sulphide added to the electrolye.

| | | ammonium sulphide = 0 ppm | | | | | |
|---|---|---|---|---|---|---|---|
| Current density | (A/m$^2$) | 5000 | 3000 | 2000 | 1200 | 750 | 300 |
| thickness | (μm) | 0.10 | 0.06 | 0.05 | 0.065 | 0.05 | 0.04 |
| | | ammonium sulphide = 20 ppm | | | | | |
| thickness | (μm) | 0.125 | 0.08 | 0.055 | 0.075 | 0.055 | 0.050 |
| | | ammonium sulphide = 40 ppm | | | | | |
| thickness | (μm) | 0.190 | 0.135 | 0.120 | 0.120 | 0.145 | 0.060 |
| | | ammonium sulphide = 100 ppm | | | | | |
| thickness | (μm) | 0.205 | 0.15 | 0.125 | 0.130 | 0.152 | 0.065 |
| | | ammonium sulphide = 300 ppm | | | | | |
| thickness | (μm) | 0.335 | 0.215 | 0.190 | 0.265 | 0.215 | 0.095 |

EXAMPLE 2

A chromium plating solution was prepared as in Example 1 except that chrometan was at a concentration of 140 g/l and the pH was 2.5

| | | ammonium sulphide = 0 ppm | | | | | |
|---|---|---|---|---|---|---|---|
| Current density | (A/m$^2$) | 5000 | 3000 | 2000 | 1200 | 750 | 300 |
| thickness | (μm) | 0.08 | 0.05 | 0.042 | 0.025 | 0.015 | 0.010 |
| | | ammonium sulphide = 50 ppm | | | | | |
| thickness | (μm) | 0.20 | 0.145 | 0.140 | 0.130 | 0.095 | 0.045 |
| | | 250 ml of water added to 1 litre of electrolyte and test repeated | | | | | |
| thickness | (μm) | 0.11 | 0.075 | 0.065 | 0.055 | 0.04 | 0.025 |
| | | 20 ppm ammonium sulphide added | | | | | |
| thickness | (μm) | 0.175 | 0.115 | 0.095 | 0.085 | 0.065 | 0.045 |

EXAMPLE 3

A chromium plating solution was prepared as in Example 1 except that 1 liter of electrolyte was diluted with 500 ml of water

| Current density | (A/m²) | 5000 | 3000 | 2000 | 1200 | 750 | 300 |
|---|---|---|---|---|---|---|---|
| | | ammonium sulphide = 0 ppm | | | | | |
| thickness | (μm) | 0.08 | 0.038 | 0.036 | 0.022 | 0.012 | 0.010 |
| | | ammonium sulphide = 30 ppm | | | | | |
| thickness | (μm) | 0.18 | 0.15 | 0.101 | 0.10 | 0.06 | 0.04 |

EXAMPLE 4

A chromium plating solution was prepared as in Example 1 except that boric acid was omitted. Very little chromium was deposited at any current density without sulphide. With 40 ppm ammonium sulphide added to the electrolyte:

| Current density | (A/m²) | 5000 | 3000 | 2000 | 1200 | 750 | 300 |
|---|---|---|---|---|---|---|---|
| thickness | (μm) | 0.19 | 0.14 | 0.10 | 0.10 | 0.090 | 0.055 |

EXAMPLE 5

A solution was prepared according to the following formulation and tested in the same way as the previous examples:

240 g/l chrometan
40 g/l boric acid
75 g/l ammonium chloride
100 g/l potassium chloride
110 g/l sodium hypophosphite
20 g/l sodium fluoride
pH=2.5
temp.=35° C.

| Current density | (A/m²) | 5000 | 3000 | 2000 | 1200 | 750 | 300 |
|---|---|---|---|---|---|---|---|
| thickness | (μm) | 0.135 | 0.09 | 0.065 | 0.050 | 0.050 | 0.050 |
| | | 1 g/l ammonium thiocyanate was added and the test repeated: | | | | | |
| thickness | (μm) | 0.205 | 0.11 | 0.070 | 0.065 | 0.065 | 0.060 |

EXAMPLE 6

An electrolyte was prepared according to U.S. Pat. No. 3,954,574, Example II:

| | |
|---|---|
| Chrometan powder | 120 g/l |
| wetting agent | 100 ppm |
| ammonium chloride | 90 g/l |
| potassium chloride | 75 g/l |
| ammonium bromide | 10 g/l |
| boric acid | 50 g/l |
| ammonium formate | 55 g/l |
| sulphuric acid SG 1.84 | 2 ml/l |

The ph on make-up was 3.1. The solution was plated out for 0.5 amp/liter in the manner described in the patent. A Hull Cell test was performed using a current of 10 amps for 1 minute.

| Current density | (A/m²) | 5000 | 3000 | 2000 | 1200 | 750 | 300 |
|---|---|---|---|---|---|---|---|
| | | ammonium sulphide = 0 ppm | | | | | |
| thickness | (μm) | 0.10 | 0.085 | 0.065 | 0.060 | 0.042 | 0.02 |
| | | ammonium sulphide = 40 ppm | | | | | |
| thickness | (μm) | 0.19 | 0.135 | 0.12 | 0.105 | 0.075 | 0.030 |

EXAMPLE 7

An electrolyte of the following formulation was prepared and tested as before:

240 g/l chrometan
40 g/l boric acid
150 g/l potassium chloride
100 g/l glycine
pH=3.0
temp. 27° C.

| Current density | (A/m²) | 5000 | 3000 | 2000 | 1200 | 750 | 300 |
|---|---|---|---|---|---|---|---|
| | | ammonium sulphide = 0 ppm | | | | | |
| thickness | (μm) | 0.10 | 0.085 | 0.065 | 0.045 | 0.04 | 0.02 |
| | | ammonium sulphide = 30 ppm | | | | | |
| thickness | (μm) | 0.165 | 0.110 | 0.105 | 0.080 | 0.058 | 0.025 |

We claim:

1. A trivalent chromium electroplating solution comprising water, trivalent chromium ions in a concentration of at least 0.1 molar, a weak complexing agent in a concentration of at least 0.1 molar, said weak complexing agent being selected from the group consisting of hypophosphite ions and glycine, and sulphide in a concentration of from 1 to 300 ppm by weight.

2. A trivalent chromium plating solution as described in claim 1 containing trivalent chromium ions in a concentration of from 0.2 molar to 2.0 molar, a weak complexing agent in a concentration of from 0.1 molar to 6.0 molar, and sulphide in a concentration of from 10 to 50 parts per million.

3. A trivalent chromium plating solution as described in claim 1 and which contains additionally ammonium ions in a concentration of from 1 to 7 molar.

4. A trivalent chromium plating solution as described in claim 1 and which contains additionally at least one buffering agent selected from the group consisting of boric acid, borate or fluoroborate, said buffering agent being in a concentration of at least 0.03 molar.

5. A trivalent chromium plating electroplating solution comprising water, trivalent chromium ions in a concentration of at least 0.1 molar, a weak complexing agent in a concentration of at least 0.1 molar, sulfide in a concentration of from 1 to 300 ppm by weight, and fluoride ions in a concentration of at least 0.025 molar.

6. A method for electrodepositing chromium on a substrate which comprises immersing said substrate as the cathode in an electrolyte solution comprising water, trivalent chromium ions in a concentration of at least 0.1 molar, a weak complexing agent in a concentration of at least 0.1 molar, said weak complexing agent being selected from the group consisting of hypophosphite ions and glycine, and from 1 to 300 parts per million by weight of sulphide and passing an electric current through said solution thereby to deposit said trivalent chromium ions on said substrate.

* * * * *